United States Patent [19]

Müller et al.

[11] Patent Number: 4,979,433

[45] Date of Patent: Dec. 25, 1990

[54] SWIRL OUTLET

[75] Inventors: Gottfreid Müller; Paul Hipp, both of Kolbingen, Fed. Rep. of Germany

[73] Assignee: Schako Metallwarenfabrik Ferdinand Schad KG, Kolbingen, Fed. Rep. of Germany

[21] Appl. No.: 410,118

[22] Filed: Sep. 20, 1989

[30] Foreign Application Priority Data

Sep. 21, 1988 [DE] Fed. Rep. of Germany ..... 3832052

[51] Int. Cl.[5] ..... F24F 13/068

[52] U.S. Cl. ..... 98/40.11; 98/40.17

[58] Field of Search ..... 98/40.11, 40.12, 40.13, 98/40.17

[56] References Cited

U.S. PATENT DOCUMENTS

| | | | |
|---|---|---|---|
| 3,092,009 | 6/1963 | Goettl | 98/40.12 |
| 3,511,163 | 5/1970 | Hewell et al. | 98/40.17 |
| 3,631,788 | 1/1972 | Larkfeldt | 98/40.11 |
| 4,163,416 | 8/1979 | Kurrle et al. | 98/40.17 |

FOREIGN PATENT DOCUMENTS

| | | | |
|---|---|---|---|
| 2313641 | 12/1976 | France | 98/40.17 |

*Primary Examiner*—Harold Joyce

*Attorney, Agent, or Firm*—Bachman & LaPointe

[57] ABSTRACT

In a swirl outlet with an outlet plate and blowout openings provided therein for warm and/or cold air, an air jet guiding slat (10) to be regulated individually is assigned to each outlet opening (5).

10 Claims, 2 Drawing Sheets

SWIRL OUTLET

The invention concerns a swirl outlet with a blowout plate and outlet openings provided therein for warm and/or cold air.

Such swirl outlets are known in many forms especially as ceiling swirl outlets. Warm and/or cold air is introduced through them into a room, this air being led up through appropriate ducts or shafts.

With regard to the emergence of the air, it is a recurrent problem that this emergence of the air ought to be arranged differently for specific rooms, room heights and fields of application. In one case, more air ought to be brought into the room more rapidly in a directly perpendicular fashion, while in another case, for example, there can be a build up of warm air parallel to the ceiling from top to bottom. Basically, each room requires its own swirl outlet in order to optimize the guidance of air.

The inventors have set themselves the aim of developing a swirl outlet of the type mentioned above, in which an individual regulation is possible of a type such that the same swirl outlet can be assigned to a plurality of rooms and fields of application.

It is conducive to the achievement of this object that an air jet guiding slat to be regulated individually is assigned to each outlet opening.

If, for example, the outlet opening is arranged as a square, it can be subdivided into four blowout surfaces by appropriate diagonals. Each of these blowout surfaces possesses outlet openings, outlet openings adjacent to the longitudinal axis running at right angles to one another.

By this means, the swirl outlet subdivides the air current into four individual blowout currents, as has also been possible in the past with other ceiling outlets of conventional type.

Since, however, according to the invention an extra air jet guiding slat is assigned to each outlet opening, the blowout current can be individually directed to all four sides.

Preferably, the air jet guiding slat is to be connected to an axis of rotation, which runs approximately parallel to the longitudinal axis of the outlet opening. By this means, it is now possible in an especially simple fashion to guide the blowout current into a relatively wide control area from the outlet opening.

In an extreme case, the air jet guiding slat touches a rim of the outlet opening with an edge, so that the blowout current is led away from the blowout plate at angle of approximately 45° widening as it does so. In the opposite operating position, the air jet guiding slat touches the opposite edge of the outlet opening, so that the blowout current is guided from the outlet opening displaced by approximately 90° . Other, intermediate settings of the air jet guiding slat are, of course, possible.

With this arrangement it is possible, for example, to achieve an aimed vertical jet in the middle of the swirl outlet, in order to bring the supply air quickly into a room as a matter of priority. With the slats which lie further out, however, the supply air can be distributed obliquely outwards in the room. However, this is intended only as an illustrative embodiment. It can easily be seen that the individual regulation of the air jet guiding slats enables an even stronger differentiation of the blowout currents. For example, one of the four blowout currents can be directed more strongly downwards, and another, by contrast, more strongly towards the middle.

For the sake of simplicity, a tubelet or the like is preferred as the axis of rotation, the air jet guiding slat forming, by means of webs, a duct in which this axis of rotation is located.

An elliptically formed hollow plastic section has turned out to be effective as a shape for the air jet guiding slot. However, the invention is not to be limited to this. The axis of rotation is preferably provided between two appropriate suspensions. Once again for the sake of simplicity, rectangular platelets which are connected to the axis of rotation, come into consideration, for example, as the suspension. In the indicated illustrative embodiment, these platelets possess an integral dove-tailed projection, with which the suspension can easily be installed in the outlet opening.

It is especially preferred that the blowout plate is surrounded laterally by upright side walls. These side walls also possess appropriate outlet openings which, in turn, are occupied in each case by an air jet guiding slat to be regulated individually. Consequently, the supply air can be brought out either along the ceiling or aimed obliquely downwards.

Should it seem desirable, the height of the side wall can be increased, so that it is here also possible to provide two or three outlet openings one above another. By this means, the swirl outlet possesses a very high free cross-section, so that a very large amount of air can be aimed into a room in a near silent fashion.

There are no restrictions on the size of the outlet. Outlets with the size of from 300×300 to 1000×1000 mm are envisaged.

Further advantages, features and details of the invention arise from the following description of preferred illustrative embodiments and with reference to the drawing, in which FIG. 1 shows a bottom view of a ceiling swirl outlet according to the invention; FIG. 2 shows a side view of the ceiling swirl outlet according to FIG. 1, represented partially cut away;

Figure 1:
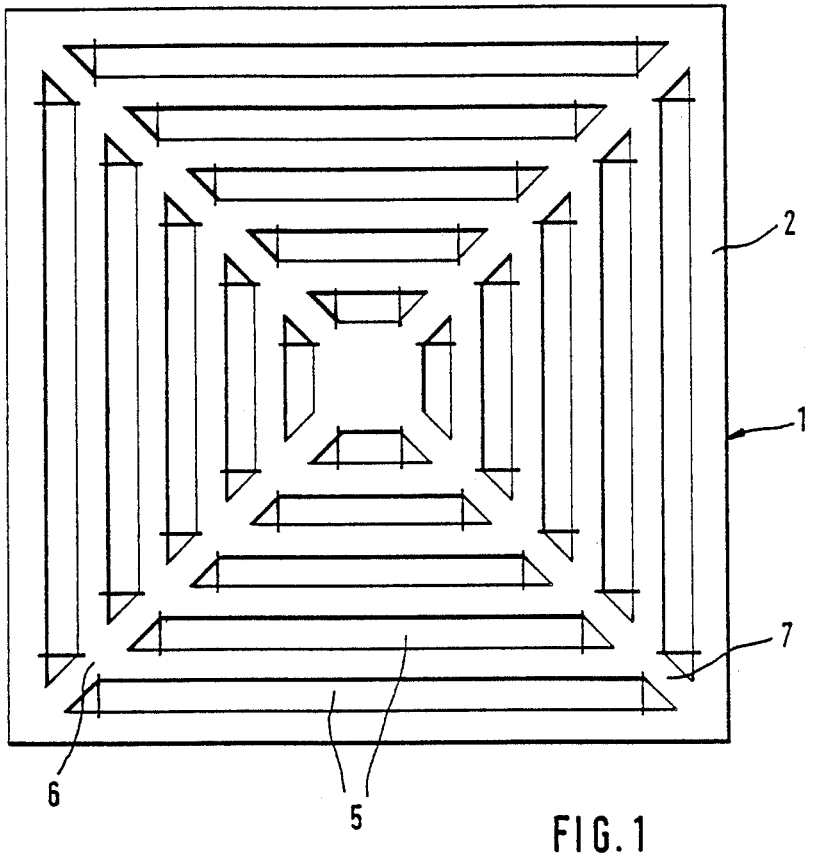
Figure 2:
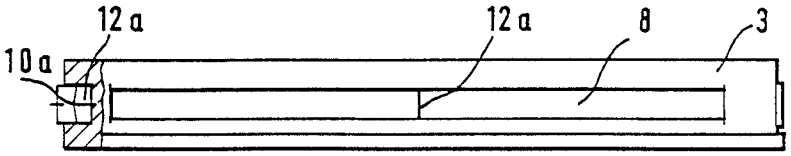

In accordance with FIG. 1, a ceiling swirl outlet according to the invention consists of an approximately square housing 1. This housing 1 possesses a blowout plate 2, as well as a frame 4, which is placed thereon and consists of side walls 3 (see FIGS. 2 and 3).

The blowout plate 2 is pierced by slot-shaped outlet openings 5, whose geometrical shape is of no significance within the scope of the invention. It is shown as an illustrative embodiment in FIG. 1 that four blowout bays are formed by two appropriate diagonals 6 and 7 which, during operation of the ceiling swirl outlet, also form four blowout currents.

The side walls 3 preferably also possess side slots 8 by means of which air currents are likewise formed.

Figure 3:
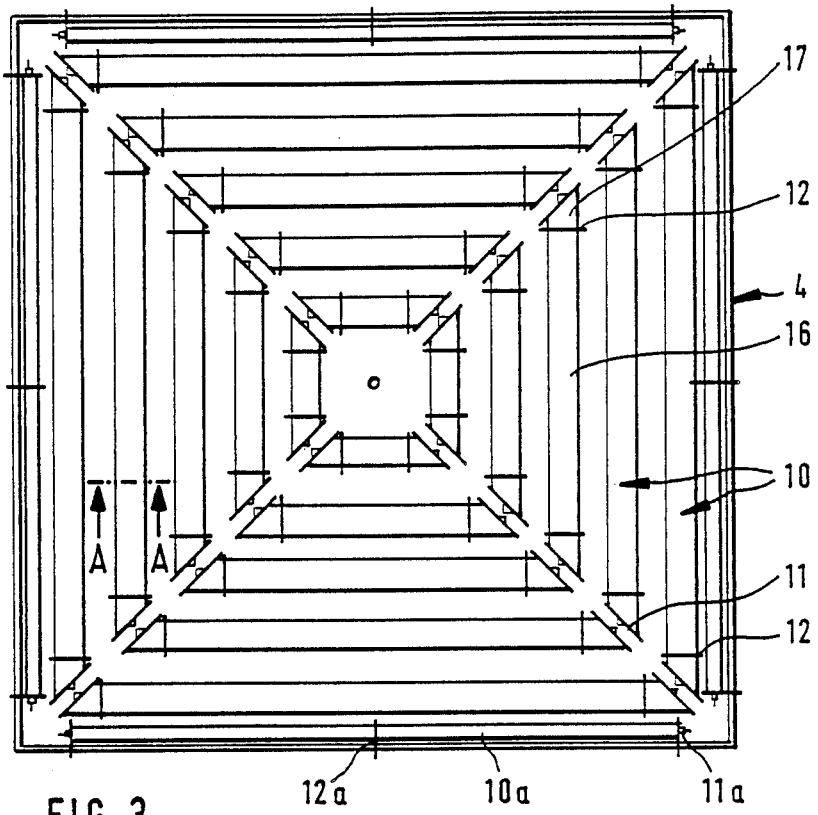
FIG. 3 shows a top view of the interior of the ceiling swirl outlet according to FIG. 1.
Figure 4:
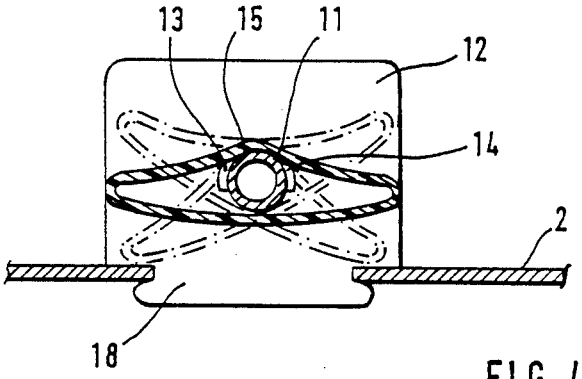
FIG. 4 shows an enlarged representation of partial cross-section along the line A—A in FIG. 3.

It may be seen from FIG. 3 that an air jet guiding slat 10 is assigned to each outlet opening 5. Each air jet guiding slat 10 is located on an axis of rotation 11, which is situated between two disc-shaped suspensions 12 (FIG. 4). In the present illustrative embodiment, each air jet guiding slat 10 consists of a hollow plastic section, and possesses in the interior a duct 15 formed by two webs 13 and 14, in which the axis of rotation 11 rests. By this means, the air jet guiding slat 10 can be rotated about the axis of rotation 11, and assume positions as shown in FIG. 4 by dots and dashes. Thus, it is possible for the particular air jet emerging from a specific outlet opening 5 to be guided according to what is required.

It is further to be seen from FIG. 3 that an air jet guiding slat 10 assigned to an outlet opening 5 can consist of a plurality of parts which, in turn, can be rotated separately about the axis of rotation 11. In the illustrative embodiment shown, each air jet guiding slat 10 consists of a principal part 16, to which there is joined at both ends, after a suspension 12 in each case, a side part 17 of a different geometrical shape which is bounded, in turn by a suspension 12. The last-named suspension is then still penetrated by the axis of rotation 11. In this way, an absolutely individual guidance of the air jet is guaranteed.

As for the rest, the disc-shaped suspensions 12 consist, for the sake of simplicity, of an essentially rectangular plate, which grips the blowout plate 2 from below with an integral dovetailed projection 18. Installing the suspension 12 in the outlet opening 5 is facilitated in this way, since the suspension 12 need only be inserted in the outlet opening 5 with its longitudinal axis approximately parallel to the axis thereof and then rotated by approximately 90°.

The side slots 8 are also preferably to be occupied by appropriate air jet guiding slats 10*a*. These air jet guiding slats 10, are also formed from a plurality of parts according to the present illustrative embodiment, and held on an axis of rotation ll*a* running between appropriate suspensions 12*a*.

We claim:

1. Swirl outlet which comprises: a housing including a blowout plate having a plurality of outlet openings therein for the discharge of warm and/or cold air, each of said outlet openings having a longitudinal axis; an air guiding slat associated with each outlet opening to individually regulate the discharge of air through said outlet openings, wherein each of said air guiding slats is located on an axis of rotation which runs approximately parallel to the longitudinal axis of the outlet opening; suspensions for each slat consisting of a platelet including an integral dovetailed projection which grips the blowout plate from below, wherein each slat can be rotated about the axis of rotation and assume different positions with respect to the associated outlet openings.

2. Swirl outlet according to claim 1 wherein said slat forms a duct by means of webs in which the axis of rotation is located.

3. Swirl outlet according to claim 2 wherein the slat consists of an elliptically formed hollow plastic section.

4. Swirl outlet according to claim 1 including side walls on the blowout plate which have side slots provided therein including air jet guiding slats therein.

5. Swirl outlet according to claim 1 wherein said outlet openings are slot-shaped.

6. Swirl outlet according to claim 1 including separating means which divide the outlet openings into separate sections.

7. Swirl outlet according to claim 1 wherein said suspensions are disk-shaped.

8. Swirl outlet according to claim 7 including two of said disk-shaped suspensions for each slat with each slat situated therebetween.

9. Swirl outlet according to claim 8 wherein each suspension is penetrated by the axis of rotation.

10. Swirl outlet according to claim 1 wherein said dovetailed projections form slots which engage the edges of the outlet openings.

* * * * *